United States Patent [19]

Lips et al.

[11] 4,417,995

[45] Nov. 29, 1983

[54] FABRIC CONDITIONING COMPOSITION

[75] Inventors: Alexander Lips, Pavenham; Martin A. Wells, Wirral; Edwin Willis, Bromborough, all of England

[73] Assignee: Lever Brothers Company, New York, N.Y.

[21] Appl. No.: 369,879

[22] Filed: Apr. 19, 1982

[30] Foreign Application Priority Data

Apr. 21, 1981 [GB] United Kingdom ..... 8112392

[51] Int. Cl.[3] ..... D06M 15/08

[52] U.S. Cl. ..... 252/174.23; 252/8.6; 252/8.8; 252/547; 252/133

[58] Field of Search ..... 252/8.6, 8.8, 8.9, 108, 252/547, 133; 424/65, 66, 68

[56] References Cited

U.S. PATENT DOCUMENTS

| | | | |
|---|---|---|---|
| 2,717,842 | 9/1955 | Vitalis | 252/8.6 |
| 2,987,474 | 6/1961 | Wilson et al. | 252/8.6 |
| 3,351,483 | 11/1967 | Miner et al. | 117/66 |
| 3,467,612 | 9/1969 | Gagliardi | 260/29.6 |
| 3,486,911 | 12/1969 | Goldstein | 252/8.6 |
| 3,592,684 | 7/1971 | Smith | 252/8.9 |
| 3,894,144 | 7/1975 | Becher et al. | 423/467 |
| 3,958,059 | 5/1976 | Diehl | 428/260 |
| 3,959,155 | 5/1976 | Montgomery et al. | 252/8.8 |
| 4,039,282 | 8/1977 | Kullman et al. | 8/184 |
| 4,205,062 | 5/1980 | Dahn | 424/66 |

FOREIGN PATENT DOCUMENTS

| | | |
|---|---|---|
| 2911198 | 9/1980 | Fed. Rep. of Germany . |
| 786388 | 11/1957 | United Kingdom . |
| 1052847 | 12/1966 | United Kingdom . |
| 1136548 | 12/1968 | United Kingdom . |
| 1285845 | 8/1972 | United Kingdom . |
| 1329961 | 9/1973 | United Kingdom . |
| 1347413 | 2/1974 | United Kingdom . |
| 1347950 | 2/1974 | United Kingdom . |
| 1483628 | 8/1977 | United Kingdom . |
| 1483627 | 8/1977 | United Kingdom . |
| 1499746 | 2/1978 | United Kingdom . |
| 1527126 | 10/1978 | United Kingdom . |
| 2024623 | 6/1978 | United Kingdom . |
| 2022415 | 12/1979 | United Kingdom . |
| 2039556 | 8/1980 | United Kingdom . |
| 2053249 | 2/1981 | United Kingdom . |

OTHER PUBLICATIONS

Reerink, et al., "The Rate of Coagulation as a Measure of the Stability of Silver Iodide Sols", Discussions of the Faraday Society 18, 74 (1954).

*Primary Examiner*—Richard L. Schilling
*Assistant Examiner*—Hoa Van Le
*Attorney, Agent, or Firm*—Milton L. Honig; James J. Farrell

[57] ABSTRACT

A fabric conditioning composition comprises a fabric conditioning agent including a cationic fabric softening material, together with an inorganic material capable of precipitating a metal hydroxide or hydrated oxide at a pH of about 7.5 of less in water. The latter material is preferably aluminum chlorhydrate. A typical composition contains about 4% quaternary ammonium cationic fabric softener and from 0.5% to 1.5% aluminum chlorhydrate. The compositions are useful as rinse products and give improved fabric softness in the presence of anionic carry-over from the wash.

10 Claims, No Drawings

FABRIC CONDITIONING COMPOSITION

This invention relates to a fabric conditioning composition particularly suitable for the conditioning (eg softening) of fabrics in the rinse step of a fabric laundering process.

It is known to add fabric conditioning agents, particularly including fabric softening materials, to the rinse step of a fabric laundering process. These fabric softening materials are often cationic materials, for example quaternary ammonium salts. As a result of the use of anionic materials for soil removal from fabrics in a preceding wash step, anionic materials find their way into the rinse water. This "carry-over" of anionic materials can have disadvantageous effects on any cationic fabric softening materials which are added to the rinse water, the anionic and cationic materials reacting together thereby reducing the quantity of cationic fabric softening material deposited on the wash load.

It is known to counteract this carry-over of anionic materials from the wash to the rinse by including in the fabric conditioning composition a secondary cationic material which is capable of tolerating more of the anionic materials before its deposition on the load is reduced. This leaves more of the primary cationic material to effect the fabric softening. Thus GB No. 2 039 556 discloses a fabric conditioning composition containing a dialkyl quaternary ammonium salt as a cationic fabric softening material and a more soluble monoalkyl quaternary ammonium salt to react with any anionic materials carried over from the wash.

One may wish to avoid the use of, for example, monoalkyl quaternary ammonium compounds for counteracting anionic carry-over for reasons of cost and processing difficulties.

It has been proposed to include ionic aluminium salts such as aluminium sulphate in fabric conditioning compositions as anti-static agents (see GB No. 1 483 628—Procter & Gamble Company). While it may be thought that such ionic salts would react with anionic materials carried over from the wash, the high electrolyte level which they generate results in product instability making their use in commercial products disadvantageous.

We have now discovered that anionic carry-over from the wash can be counteracted by incorporating in the fabric conditioning composition certain inorganic polymeric materials.

Thus, according to the invention there is provided a fabric conditioning composition in liquid or granular solid form comprising a fabric conditioning agent which includes at least one cationic fabric softening material, characterised in that the composition further comprises an inorganic polymeric material capable of precipitating a metal hydroxide or hydrated oxide at a pH of about 7.5 or less in water, the weight ratio of the fabric conditioning agent to the inorganic polymeric material being at least about 1.5:1.

The inorganic polymeric material is preferably such a material which has a low degree of ionisation in the product to prevent coagulation and phase separtion of the positively charged softener particles. In order to determine the degree of ionisation of an inorganic polymeric material, the test described in Reerink & Overbeck, Discuss Faraday Soc. 18, 74(1954) may be utilised. In this test the rate at which a test material is capable of coagulating a positively charged dispersion of polystyrene particles has been determined, and has been used to derive a stability ratio W, where $$W = \frac{\text{the most rapid rate of coagulation possible}}{\text{the measured rate for the test material.}}$$

The positively charged dispersion used was prepared by polymerising styrene in the presence of azo—N,N', dimethyl isobutyramidine hydrochloride initiator. This dispersion had an average particle size of 0.41 microns. The rate measurements were made at pH3 by following turbidity changes in a spectrometer at 400 nM.

The concentration of test material required to just reach a state of rapid coagulation (ie where W=1) is called the "critical coagulation concentration". The higher the "critical coagulation concentration", the more stable will be the dispersion to coagulation. It is preferred that the inorganic polymeric material used in the present invention has a critical coagulation concentration with this dispersion of at least about 0.1 M, preferably at least about 0.2 M.

The precipitates which form when the inorganic polymeric materials used in this invention are diluted into the rinse water enable the fabric conditioning compound to deposit onto fabrics even in the presence of substantial quantities of anionic carry-over from the wash. Preferably the inorganic polymeric material is a compound of aluminium (III), zirconium (IV) or titanium (IV).

Suitable inorganic polymeric materials for use in the present invention include aluminium chlorohydrate, zirconium chlorohydrate, aluminium-zirconium chlorohydrate and titanium bromohydrate.

The fabric conditioning agent for use in the compositions of the invention includes at least one cationic fabric softening material. Suitable cationic fabric softening materials and mixtures thereof are well known in the art, particularly from Schwartz, Perry & Berch, "Surface Active Agents" (Vol I and II), from Davidson & Milwidsky, "Synthetic Detergents" (6th Edition, John Wiley and Sons 1978) and from Gutcho, "Household and Industrial Fabric Conditioners" (Noyes Data Corporation 1980). The reader's attention is directed to these documents for lists of suitable cationic fabric softening materials.

In particular, the present invention is of advantage if the cationic fabric softening material is an alkyl quaternary ammonium salt of the general formula $$R^1R^2R^3R^4N^+X^-,$$

where $R^1$ and optionally $R^2$ is a substituted or unsubstituted, saturated or unsaturated, straight or branched chain alkyl group having 8 to 22 carbon atoms, $R^3$, $R^4$ and optionally $R^2$ is an alkyl or substituted alkyl group having 1 to 4 carbon atoms and $X^-$ is an anion. An alternative class of cationic fabric conditioning agents are the imidazolinium compounds of the general formula

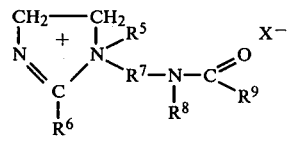

where $R^5$ is an alkyl group having 1 to 4 carbon atoms, $R^6$ is an alkyl group having 8 to 25 carbon atoms, $R^7$ is a divalent alkyl group having 1 to 4 carbon atoms, $R^8$ is hydrogen or an alkyl group having 1 to 4 carbon atoms and $R^9$ is hydrogen or an alkyl group having 8 to 25 carbon atoms, each of the alkyl groups being either saturated or unsaturated, substituted or unsubstituted, linear or branched alkyl group.

Specific examples of suitable cationic fabric softening materials include cetyl trimethyl ammonium bromide, dihardened tallow dimethyl ammonium chloride (available as Arquad 2HT), distearyl dimethylammonium chloride (available as Arosurf TA100), 1-methyl-1-oleylamidoethyl-2-oleylimidazolinium methosulphate and the disoft tallow equivalent (available as Varisoft 475).

The fabric conditioning agent for use in the compositions of the invention may also include other cationic fabric conditioning materials, such as cationic anti-static materials, and non-cationic fabric softening materials such as nonionic fabric softening materials. When nonionic fabric softening materials are included, the weight ratio of the cationic fabric softening material to the nonionic fabric softening material should be at least about 1:1, preferably at least about 3:1.

The fabric conditioning compositions according to the invention may be in liquid or granular solid form.

When in liquid form, the product may be in the form of a dilute rinse conditioner (containing say up to about 20% total active material) or in concentrated form. Suitable formulations for concentrated rinse conditioners will include viscosity control agents such as are disclosed in GB No. 2 053 249 (Unilever Limited) where the compositions contain materials such as polyethylene glycol and U.S. Pat. No. 4,149,978 (Goffinet assigned to Procter & Gamble Company) where the compositions contain hydrocarbons, these disclosures being incorporated herein by reference. An alternative viscosity control agent is lanolin.

In dilute liquid fabric conditioning compositions the concentration of the fabric conditioning agent may be from about 0.5% to about 30% by weight, preferably from about 1.5% to about 10% by weight. The inorganic material may occupy from about 0.1% to about 2.5% by weight, preferably from about 0.25% to about 1.0% by weight. The ratio of the fabric conditioning agent to the inorganic material is at least about 1.5:1, preferably less than about 40:1 by weight, most preferably from about 4:1 to about 20:1. In concentrated liquid fabric conditioning compositions the concentration of the fabric conditioning agent may be from about 10% to about 60% by weight, preferably from about 30% to about 50% by weight. In this case the ratio of the fabric conditioning compound to the inorganic material is preferably from about 3:1 to about 80:1, most preferably from about 10:1 to about 60:1.

When in liquid form, the fabric conditioning composition will contain, in addition to the fabric conditioning agent and the inorganic polymeric material, a liquid carrier such as an aqueous base which may consist only of water or of a mixture of water with other materials such as those referred to below.

It is preferred that the pH of the products of the invention lies between about 3 and about 10, preferably between about 4 and about 6. On dilution in the rinse liquor the pH will generally change to about 6 to about 8.

The compositions according to the invention may further include materials conventionally added to fabric conditioning compositions such as buffering agents, organic solvents, emulsifiers, colouring materials, bactericides, antioxidants, fluorescers, perfumes, perfume carriers, bleaches and hydrotropes.

When the fabric conditioning agents are in solid eg granular form, they may be prepared either by dry blending the ingredients or by adsorbing the ingredients on a solid carrier, such as silica. Alternatively the compositions may be formed into a slurry which is subsequently spray dried. In the case of a solid composition it is preferred that the composition contains from about 0.5% to about 85% by weight of the fabric conditioning agent or mixture thereof, more preferably from about 2% to about 25% by weight, while the inorganic material accounts for from 0.1% to about 8% by weight, more preferably from about 0.3% to about 2.5% by weight. The remainder of the solid composition will be made up of the solid carrier optionally together with the conventional additives for solid fabric conditioning compositions, such as those listed above for liquid compositions.

The inorganic material included in the compositions may confer other benefits, once deposited on the fabric. Thus, the inorganic material may, in addition to reducing the effect of anionic carry-over from the wash, act as a deodorant (as in the case of aluminium or zirconium chlorhydrate), a germicide, an anti-redeposition material, an anti-static material, an anti-yellowing material, an ironing aid, an anti-crease agent, a perfume carrier, or an anti-oxidant.

The compositions of the present invention may be prepared by a variety of methods. One suitable method, in the case of dilute liquid fabric conditioning compositions, is to form a molten premix consisting of the fabric conditioning agent, water and optionally a solvent and adding the inorganic polymeric compound to this molten premix in the presence of sufficient water to give the desired dilution in the product.

The invention will now be further illustrated by the following non-limiting Examples, in which percentages are by weight of the total composition.

EXAMPLE 1

43.1 g of Arosurf TA-100 (a cationic fabric softening material having a composition approximating to distearyl dimethyl ammonium chloride), 6.9 g Pristerene 63 (a nonionic fabric softening material consisting essentially of a mixture of saturated and unsaturated alkyl fatty acids having an alkyl chain length varying between $C_{12}$ and $C_{22}$), 10 g isopropanol and 5 g of water were mixed together, heated to 65° C. and maintained at that temperature until wholly clear and homogenous. This molten premix was then added to 935 ml of dimeralised water at 65° C. containing various amounts of aluminium chlorhydrate in 50% active form. The mixture was stirred mechanically for 10 minutes in a water bath at 65° C. and then allowed to cool to ambient temperatures. The products formed had the following compositions.

| Example: | 1A | 1B | 1C | 1D |
|---|---|---|---|---|
| Arosurf TA-100, g | 43.1 | 43.1 | 43.1 | 43.1 |
| Arosurf TA-100, % | 4.31 | 4.31 | 4.31 | 4.31 |
| Pristerene 4916, g | 6.9 | 6.9 | 6.9 | 6.9 |
| Pristerene 4916, % | 0.69 | 0.69 | 0.69 | 0.69 |

-continued

| Example: | 1A | 1B | 1C | 1D |
|---|---|---|---|---|
| Aluminium chlorhydrate (50% active), g | 30.0 | 20.0 | 10.0 | — |
| Aluminium chlorhydrate % | 1.50 | 1.00 | 0.50 | — |
| Fabric conditioning agent/ inorganic polymeric material weight ratio | 3.3 | 5.0 | 10.0 | — |

The softness performance of these formulations was examined in a rinse liquor which had the following characteristics:

| | |
|---|---|
| DOBS 055 (Anionic surfactant representing carry-over from the wash) | 24 ppm |
| Test product, sufficient to give cationic and nonionic content of | 50 ppm |
| Water hardness | 24° |
| Cloth | Three pieces of Terry towelling weighing 40 g |
| Total liquor volume | 800 ml |

The softness of the test fabrics was assessed by a panel of assessors familiar with a ranking system in which the lower the ranking the better the softness. The results were as follows:

| Example | Ranking |
|---|---|
| 1A | 2.05 |
| 1B | 2.48 |
| 1C | 2.32 |
| 1D | 3.12 |

EXAMPLE 2

50 g of Arosurf TA-100, 10 g of isopropanol, and 5 g of water were mixed together, heated to 65° C. and maintained at that temperature until wholly clear and homogenous. This molten premix was then added to 935 ml of demineralised water at 60° C. containing various amounts of 50% aluminium chlorhydrate or Al/Zr chlorhydrate in the form of a product available as Rezal 36, manufactured by Reheis, and consisting approximately of aluminium zirconium chlorhydrate with a Al/Zr ratio of 3.6:1 and a metal/Cl ratio of 1.6:1. The mixture was stirred mechanically for 10 minutes and then allowed to cool to ambient temperatures. The products formed had the following compositions.

| Example | 2A | 2B | 2C | 2D | 2E |
|---|---|---|---|---|---|
| Arosurf TA-100, g | 50.0 | 50.0 | 50.0 | 50.0 | 50.0 |
| Arosurf TA-100, % | 5.0 | 5.0 | 5.0 | 5.0 | 5.0 |
| Al/Zr chlorhydrate g | 10.0 | 5.0 | — | — | — |
| Al/Zr chlorhydrate % | 1.0 | 0.5 | — | — | — |
| Aluminium chlorhydrate (50% active), g | — | — | 20.0 | 10.0 | — |
| Aluminium chlorhydrate % | — | — | 1.0 | 0.5 | — |
| Fabric conditioning agent/ inorganic polymeric material weight ratio | 5.0 | 10.0 | 5.0 | 10.0 | — |

The softness performance of these formulations was examined in rinse liquors which had the following characteristics:

| | Test 1 | Test 2 |
|---|---|---|
| DOBS 055 | 35 ppm | 20 ppm |

-continued

| | Test 1 | Test 2 |
|---|---|---|
| Test product - sufficient to give a cationic content of | 35 ppm | 35 ppm |
| Water hardness | 24° | 24° |
| Temperature | Ambient | Ambient |
| Cloth | Three pieces of Terry towelling weighing 40 g | |
| Total liquor volume | 800 ml | 800 ml |

The softness of the test fabrics was assessed by a panel of assessors familiar with a ranking system in which the lower the ranking the better the softness. The results were as follows:

| Example | Ranking (Test 1) | Ranking (Test 2) |
|---|---|---|
| 2A | 2.42 | 2.23 |
| 2B | 2.32 | 2.25 |
| 2C | 1.55 | 2.00 |
| 2D | 2.35 | 2.55 |
| 2E | 3.87 | 3.47 |

EXAMPLE 3

A concentrated rinse conditioner was prepared by mixing its components, without heating, the aluminium chlorhydrate being added thereto in a 50% active form. The resultant product had the following approximate composition:

| | |
|---|---|
| Di (non-hardened tallow) imidazolinium methosulphate (added as 53.3% of a 75% dispersion) | 40.0% |
| Polyethylene glycol (Molecular weight 2000) | 10.0% |
| Aluminium chlorhydrate | 0.75% |
| Demineralised water | balance |
| Fabric conditioning agent/inorganic polymeric material weight ratio | 53.3:1 |

EXAMPLE 4

A concentrated rinse conditioner was prepared using the same method used for the composition of Example 3. The resultant product had the following approximate composition.

| | |
|---|---|
| Di (non-hardened tallow) imidazolinium methosulphate (Added as 39.5% of a 75% dispersion) | 29.6% |
| Polyethylene glycol (MW 6000) | 14.0% |
| Aluminium chlorhydrate | 1.5% |
| Demineralised water | balance |
| Fabric conditioning agent/inorganic polymeric material weight ratio | 19.7:1 |

EXAMPLE 5

A concentrated rinse conditioner was formed by mixing (without heating) 26.3 parts by weight of a 75% dispersion of di (non-hardened tallow) imidazolinium methosulphate, and 2 parts by weight of aluminium chlorhydrate in 50% active form with 71.7 parts by weight of demineralised water. The resulting weight ratio of fabric conditioning agent to inorganic polymeric material was about 19.7:1.

EXAMPLE 6

A rinse conditioner was formed by warming to 60° C. a mixture of 19 parts of a 75% dispersion of di (non-hardened tallow) imidazolinium methosulphate, 10 parts technical paraffin ($C_{14/17}$), 9 parts of a 50% dispersion of coconut alkyl trimethyl ammonium chloride and three parts of aluminium chlorhydrate in 50% active form, the balance to 100 parts being made up with demineralised water.

EXAMPLE 7 and 8

Fabric conditioning compositions were prepared according to the following table. In each case the compositions were prepared by mixing the ingredients together in water, heating to a temperature of about 60° C. and agitating for at least 5 minutes.

| Example | 7 | 8 |
|---|---|---|
| Varisoft 475 | — | 15.5 |
| Arosurf TA 100 | 10.5 | — |
| Lanolin | 9.5 | 9.5 |
| Aluminium chlorhydrate | 1.0 | 0.3 |
| Water | | balance to 100 |

The pH of the products disclosed in the Examples is between about 5.0 and about 6.0. Aluminium chlorhydrate used in the Examples has a critical coagulation concentration of about 0.47 M.

We claim:

1. A fabric conditioning composition in liquid form comprising from about 0.5% to about 60% by weight of a fabric conditioning agent which includes at least one cationic fabric softening material, characterized in that the composition further comprises from about 0.1% to about 8% by weight of an inorganic polymeric material capable of precipitating a metal hydroxide or hydrated oxide at a pH of about 7.5 or less in water, the weight ratio of the fabric conditioning agent to the inorganic polymeric material being at least about 1.5:1.

2. A fabric conditioning composition according to claim 1, characterised in that the inorganic polymeric material has critical coagulation concentration (as hereinbefore defined) of at least about 0.1 M.

3. A fabric conditioning composition according to claim 1, characterised in that the inorganic polymeric material has a critical coagulation concentration (as herebefore defined) of at least about 0.2 M.

4. A fabric conditioning composition according to claim 1, characterised in that the inorganic polymeric material is selected from compounds of aluminium, titanium and zirconium, and mixtures thereof.

5. A fabric conditioning composition according to claim 1, characterised in that the weight ratio of the fabric conditioning agent to the inorganic polymeric material is between about 4:1 and about 20:1.

6. A fabric conditioning composition according to claim 1, characterized in that the fabric conditioning agent comprises a mixture of at least one cationic fabric softening material with at least one nonionic fabric softening material in a weight ratio of at least about 1:1.

7. A fabric conditioning composition according to claim 1, in liquid form, characterised by containing an aqueous base, from about 0.5% to about 30% by weight of the fabric conditioning agent and from about 0.1% to about 2.5% by weight of the inorganic polymeric material, the weight ratio of the fabric conditioning agent to the inorganic polymeric material being less than about 40:1.

8. A fabric conditioning composition according to claim 1, in liquid form, characterised by containing an aqueous base, from about 10% to about 60% by weight of the fabric conditioning agent and sufficient of the inorganic polymeric material to yield a weight ratio of the fabric conditioning agent to the inorganic polymeric material of between about 3:1 and about 80:1.

9. A fabric conditioning composition according to claim 7 or 8, characterised by having a pH between about 4.0 and about 6.0.

10. A fabric conditioning composition according to claim 1, characterized in that the inorganic polymeric material is aluminium chlorhydrate.

* * * * *